US006074033A

United States Patent [19]

Sayama et al.

[11] Patent Number: 6,074,033

[45] Date of Patent: Jun. 13, 2000

[54] DEVICE FOR DRIVING INKJET PRINT HEAD

[75] Inventors: Tomohiro Sayama; Shuji Yonekubo, both of Nagano, Japan

[73] Assignee: Seiko Epson Corporation, Nagano, Japan

[21] Appl. No.: 09/035,364

[22] Filed: Mar. 5, 1998

[30] Foreign Application Priority Data

Mar. 12, 1997 [JP] Japan ..... 9-057874

[51] Int. Cl.[7] ..... B41J 29/38

[52] U.S. Cl. ..... 347/10

[58] Field of Search ..... 347/10, 68, 9, 347/11, 14

[56] References Cited

U.S. PATENT DOCUMENTS

| | | | |
|---|---|---|---|
| 4,980,699 | 12/1990 | Tanabe et al. . | |
| 5,631,675 | 5/1997 | Futagawa | 347/10 |

FOREIGN PATENT DOCUMENTS

| | | |
|---|---|---|
| 0721840 | 1/1996 | European Pat. Off. . |
| 0738602 | 4/1996 | European Pat. Off. . |
| 5-220947 | 8/1993 | Japan . |
| WO95/16568 | 6/1995 | Japan . |

OTHER PUBLICATIONS

Patent Abstracts of Japan, vol. 004, No. 057 (M–009), Apr. 26, 1980 & JP 55 022972.

Patent Abstracts of Japan, vol. 016, No. 270 (M–1266), Jun. 17, 1992 & JP 04 065245.

Patent Abstracts of Japan, vol. 011, No. 090 (M–573), Mar. 20, 1987 & JP 61 242850 A.

*Primary Examiner*—William Royer
*Assistant Examiner*—Greg Moldafsky
*Attorney, Agent, or Firm*—Sughrue, Mion, Zinn, Macpeak & Seas, PLLC

[57] ABSTRACT

To prevent a deficiency of ink supply in a high drive frequency inkjet head operating at low ambient temperatures, and to reduce temperature dependent ink squirting variations, an inkjet head is driven at an ink jetting cycle that compensates for temperature. In particular, the ink jetting cycle of a drive waveform includes a period (t1) of constriction of the pressure generation chamber, a period (t2) of holding the drive voltage, and a process (t3) of expansion of the pressure generation chamber. With a decrease in the ambient temperature of ink, the sum of the periods t1, t2, and t3 is changed from a time period which is (n+1 / 4) (where n=1, 2, 3) times as much as the cycle of inherent oscillation T of the pressure generation chamber to a time period which is (n+3 / 4) times as much as T or to a time period which is (n−1 / 4) times as much as T. As a result, a low ambient temperature ink supply deficiency can be prevented without the use of an ink heater or the like.

8 Claims, 5 Drawing Sheets

DRIVE WAVEFORM DATA 41

| TITLE | TIME | VOLTAGE | MODE |
|---|---|---|---|
| t5 | 6μs | -2V/μs | DISCHARGE |
| t6 | 2μs | ±0V/μs | HOLD |
| t1 | 2μs | +15V/μs | RECHARGING |
| t2 | 5μs (FROM 25°C OR MORE TO 40°C OR LESS)<br>5 + (50 - 2 Temp) /5μs<br>(FROM 15°C OR MORE TO LESS THAN 25°C)<br>9μs (15°C) | ±0V/μs | HOLD |
| t3 | 3μs | -6V/μs | DISCHARGE |
| t4 | 1/f - t1 - t2 - t3 - t5 - t6 μs | ±0V/μs | HOLD |

Temp REPRESENTS A TEMPERATURE (°C)
"f" REPRESENTS A DRIVE FREQUENCY (MHz)

DEVICE FOR DRIVING INKJET PRINT HEAD

BACKGROUND OF THE INVENTION

1. Field of the Invention

The present invention relates to driving an inkjet recorder equipped with a recording head that records characters or graphics by pressurizing and squirting ink through use of a piezoelectric element.

2. Related Art

Ink is used in inkjet print heads. For the proper operation of inkjet print heads, it is important that the ink have consistent physical properties. It is not always possible, however, for the physical properties of the ink to be identical because of various external factors. One such external factor affecting the physical properties of inkjet ink is ambient temperature. In particular, the ambient temperature of the print head affects the viscosity and the surface tension of inkjet ink. That is, the lower the ambient temperature, the more viscous the ink becomes. The higher the ambient temperature, the less viscous the ink becomes.

To put it another way, inkjet ink has some physical properties that are temperature dependent. The temperature dependent physical properties of inkjet ink result in a variation in the squirting characteristics of an ink droplet (such as squirting velocity or droplet weight), thereby adversely affecting print quality.

One exemplary method of driving an inkjet print head is disclosed in the International Patent Application (IPA) WO 95/16568, for which the international publication has been effected. According to this IPA, a piezoelectric element at an intermediate drive voltage is discharged to the minimum drive voltage, thereby to draw ink into a pressure chamber by suction.

In other words, a pressure generating chamber is expanded, which pulls ink from an ink reservoir into the pressure generating chamber. Immediately after the sucking/expanding operation, the piezoelectric element is charged to the maximum voltage, thereby to squirt ink. In other words, the pressure generating chamber is contracted, forcing an ink droplet out. Immediately after the squirting of ink, the piezoelectric element is discharged back to the intermediate drive voltage. That is, in the basis drive method of the above-identified IPA, the pressure generating chamber first is expanded and draws ink into the pressure generating chamber and then the pressure generating chamber is contracted, pushing an ink droplet out from the chamber The basic drive method according to the above-identified IPA provides a good example of the negative effects that temperature can have on printing quality. This basic drive method does not take into account temperature. If the drive method of the above-identified IPA is used in the entire range of likely ambient temperatures, and particularly for drive frequencies at or over 20 kHz, problems are encountered. Such problems will shortly be noted, but first it is important to note that the drive frequency of an inkjet print head may generally be understood to mean the number of times ink droplets are squirted per unit of time. It is also important to note that the jetting or squirting of an ink droplet is an operation in which residual vibrations are encountered, and that at frequencies of 20 kHz or more, the influence of the residual vibration of an ink meniscus manifests itself.

Now, the problems encountered in the drive method according to the above-identified IPA will be pointed out. As the ambient temperature decreases, as has already been mentioned, the viscosity of the ink increases. In other words, the ink becomes thicker. The amount of ink drawn into the pressure generating chamber during the expansion of the chamber thus is decreased in relation to the increase in ink viscosity. In addition, the higher ink viscosity causes the meniscus of the ink to return to a discharge orifice at a slower rate after the squirting operation. This means that the next ink droplet gets squirted when the meniscus has not yet returned to the ideal, higher ambient temperature position. To put it another way, because the ink is more viscous at the lower temperature, the ink meniscus might not return to the proper position in time for the jetting of the next ink droplet; the meniscus might be too deep within the pressure generating chamber. This improper positioning of the meniscus causes the amount of jetted ink to be reduced correspondingly and, moreover, the jetted droplet might have a linear shape instead of the desired granular shape. Overall, the foregoing factors combine to produce a significant decrease in the total amount of ink jetted. This decrease in the total amount of ink jetted results in the inevitable degradation of picture quality.

One approach to avoid the adverse effects of the temperature dependent physical properties of inkjet ink is to ensure the ink is always near a particular temperature. Laid-open JPA Hei. 5-220947 exemplifies this approach. In particular, this JPA provides that, when the ambient temperature is low, the ink is heated to a temperature close to room temperature before being squirted. This technique is not entirely advantageous. Although the temperature dependency of the physical properties is ameliorated, it is necessary to provide an ink heater. The addition of an ink heater adds to the manufacturing cost of the print head.

SUMMARY OF THE INVENTION

It is an object of this invention to teach a method and device for driving an inkjet print head in which the temperature dependent physical characteristics of inkjet ink are compensated. It is furthermore an object of this invention to provide such a method and device such that the need for an ink heater is eliminated, thereby resulting in a more economical print head.

In general, the invention provides that, at higher ambient temperatures, the residual vibration of a piezoelectric vibration plate is dampened by a drive signal to avoid the undesired jetting of ink droplets, but at lower ambient temperatures, the residual vibration of a piezoelectric vibration plate is reinforced by a drive signal so as to enhance the ink drawing or sucking action of the pressure generating chamber. The dampening effect is achieved by timing the drive signal to occur in opposition to part of the natural residual vibration cycle of the piezoelectric plate, and the reinforcing effect is achieved by timing the drive signal to occur in synchronism with part of the natural residual vibration cycle.

To solve the foregoing problems, the present invention provides a device and method for driving an inkjet head including a pressure generation chamber communicated with an ink chamber shared between the pressure generation chamber and a discharge orifice; pressure generation means, wherein by combination of three processes as required, namely, the process for maintaining a drive voltage, the process for recharging, and the process for discharging, the pressure generation means causes the pressure generation chamber to expand or constrict, thereby drawing ink or squirting an ink droplet from the discharge orifice. More particularly, the device and method for driving an inkjet head for ejecting ink droplets from nozzle openings by applying a drive voltage to a pressure generation chamber, the pressure generation chamber communicating with the ink chamber commonly with the nozzle openings, the inkjet print head driving method comprising steps of: a first step for applying a drive voltage for contracting the pressure generation chamber; a second step for substantially maintaining the drive voltage after said first step; and a third step for expanding the pressure generation chamber after said second step, wherein a timing of executing said third step is varied for controlling residual vibrations of the pressure generation chamber in accordance with ambient temperature of ink.

In an attempt to squirt an ink droplet through constriction of the pressure chamber by recharging (or discharging) the pressure generation means, if after the lapse of the recharging (or discharging) time period the pressure generation means proceeds to a step of maintaining a drive voltage while still remaining in the final fraction of the recharging (or discharging) time period, a piezoelectric vibration plate serving as the pressure generation means is subjected to the residual vibration defined by the cycle of inherent oscillation T of the piezoelectric vibration plate. However, by changing the timing immediately before holding the drive voltage when the pressure generation means has been discharged (or recharged) after the lapse of the time period during which the drive voltage is maintained, it may be possible to prevent residual vibration developing in the piezoelectric vibration plate or to amplify the residual vibration. If the residual vibration of the piezoelectric vibration plate is prevented, unwanted squirting of ink (i.e., a satellite phenomenon) can be eventually prevented. This is a method of setting the drive waveform particularly when the viscosity of ink is decreased at the high ambient temperature. Conversely, in a case where the ambient temperature is low; that is, the viscosity of ink is increased, if the time period is set so as not to prevent the residual vibration from occurring in the piezoelectric vibration plate, the meniscus can return to the discharge orifice at a higher speed by virtue of an pumping effect induced by the residual vibration of the piezoelectric vibration plate. As a result, it becomes able to return the meniscus to the discharge orifice at substantially the same speed as that at which the meniscus returns at a high ambient temperature. So long as the timing at which the residual vibration is prevented from occurring in the piezoelectric vibration plate and the timing at which the residual vibration is not prevented from occurring are changed according to the ambient temperature, it becomes able to realize a high-frequency drive method corresponding to the viscosity of ink.

DETAILED DESCRIPTION OF THE PREFERRED EMBODIMENTS

With reference to the accompanying drawings, an embodiment of the present invention will now be described. It is to be understood that the embodiment described is for the purpose of explanation only, and that the invention is embodied in the concepts presented.

Figure 1:
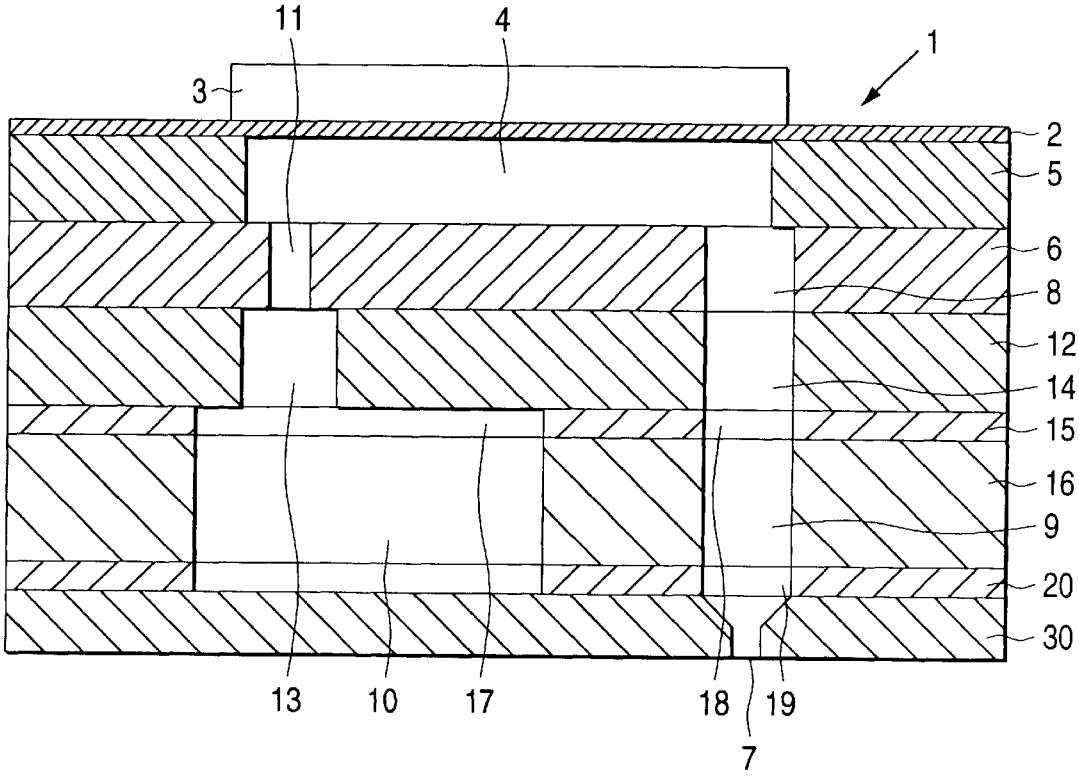
FIG. 1 is a cross-sectional view showing an inkjet recording head according to one embodiment used for the present invention.

FIG. 1 shows one embodiment of an inkjet recording head used for the present invention. In the drawing, reference numeral 1 designates a drive unit having a vibration plate 2 which is formed, e.g., from zirconia into a thin plate. It will be appreciated that an inkjet recording head (also referred to as an inkjet print head) includes many pressure generating chambers and nozzles, but that only one of each is shown in FIG. 1.

Piezoelectric vibration plate 3 is formed from PZT and mounted on the surface of the vibration plate 2 so as to oppose pressure generating chamber 4, which will be described later.

Reference numeral 5 designates a spacer which is formed, e.g., from a ceramic plate such as zirconia ($ZrO_2$), to a thickness suitable for the formation of the pressure generation chamber, e g., a thickness of 100 $\mu$m. Communicating holes which correspond to the profile of the pressure generation chambers 4 in shape are formed in the spacer 5 at given pitches.

Reference numeral 6 designates a substrate for closing the side of pressure generation chamber 4 opposite the piezoelectric vibration plate 3. A communicating hole 8 is formed in the vicinity of one end of the pressure generating chamber 4 for connecting the pressure generation chamber 4 to the discharge orifice or nozzle 7. A communicating hole 11 is formed in the vicinity of the other end of each pressure generating chamber 4 for connecting the pressure generation chamber 4 to an ink chamber 10 (also referred to as a common chamber). Communicating hole 11 doubles as a channel limit hole, and has substantially the same channel resistance as that of nozzle hole 7.

The three members 1, 5, and 6 are assembled into one unit. This unit is mounted on a unit mount plate 12, by means of an adhesive. A communicating hole 13 is formed in the unit mount plate 12 for connecting the communicating hole 11 to the common ink chamber 10. Further, a communicating hole 14 is formed in the unit-mount plate 12 so as to oppose communicating hole 8 and to connect the communicating hole 8 to the discharge orifice 7.

Reference numeral 15 designates a thermally fusible film which bonds plate 12 to a common ink chamber construction plate 16. Window 17 matches common ink chamber 10, and communicating hole 18 connects the discharge orifice 7 to the pressure generation chamber 4; window 17 and hole 18 are formed in the thermally fusible film 15.

Common ink chamber construction plate 16 is formed from corrosion-resistant plate material, such as stainless steel, to a thickness suitable for the formation of the common ink chamber 10; e.g., a thickness of 120 μm. Communicating holes, each corresponding to the profile of the common ink chamber 10, and communicating hole 9 each connecting the pressure chamber 4 to the discharge orifice 7, are formed in the common ink chamber construction plate 16.

Reference numeral 30 designates a nozzle plate. The discharge orifice 7 is formed in the nozzle plate 30 in such a way that discharge orifice 7 is located in the vicinity of one end of the pressure generation chamber 4. The nozzle plate 30 is bonded to the common ink chamber construction plate 16 by means of a thermally fusible film 20 in such a way that the discharge orifice 7 is connected to the pressure generation chamber 4 through the communicating holes 8, 14, 18, 9, and 19.

For convenience, it may be said that there is an ink supply path between ink chamber 10 and pressure generating chamber 4 which ink supply path includes holes 17, 13, and 11. Likewise, it may be said that communicating holes 8, 14, 18, 9, and 19 form an ink discharge path from pressure generating chamber 4 to nozzle opening 7. To put it another way, the ink supply path and chamber may together be said to be a means for supplying ink to pressure generating chamber 4. Likewise, the is ink discharge path and nozzle may together be said to be a means for delivering a jetted ink droplet from pressure generating chamber 4. One of skill in this field would appreciate, however, that the print head shown in FIG. 1 is merely representative in construction. It is possible to eliminate certain layers, or to combine two into one. It also is possible to provide a construction in which the nozzle is closer to or immediately adjacent to the pressure generating chamber.

In the inkjet recording head having the configuration as in FIG. 1, a drive signal is used to cause compression and expansion in pressure generating chamber 4. The drive signal is provided as a voltage to piezoelectric vibration plate 3. When the drive signal increases, the voltage applied to piezoelectric vibration plate 3 increases. When the voltage applied to piezoelectric vibration plate 3 increases, the vibration plate 2 is warped toward the pressure generation chamber 4, thereby constricting or compressing the pressure generation chamber 4. Assuming that the vibration plate 2 begins at a non-warped position, the application of an increasing drive signal causes the chamber 4 to be constricted or compressed. As a result of this constriction, some of the ink in pressure generating chamber 4 is pushed through the ink discharge path and toward nozzle 7. This movement of ink results in the jetting or squirting of an ink droplet from the nozzle or the discharge orifice 7.

When the drive signal decreases, the voltage applied to piezoelectric vibration plate 3 decreases. When the voltage applied to piezoelectric vibration plate 3 decreases, the vibration plate 2 is warped away from the pressure generating chamber 4, thereby expanding the pressure generating chamber 4. Assuming that the vibration plate 2 has just been warped so as to jet an ink droplet, the application of a decreasing drive signal now causes the chamber 4 to expand toward its original uncompressed size. During the course of such an expansion of the pressure generation chamber 4, an amount of ink corresponding to the amount of the ink that was jetted flows into the pressure generation chamber 4 from the common ink chamber 10 via the ink supply path (which includes channel limit hole 11).

The piezoelectric vibration plate 3 may be understood to provide a means for generating pressure in the pressure generating chamber 4 or, alternatively, pressure generating means.

Figure 2:
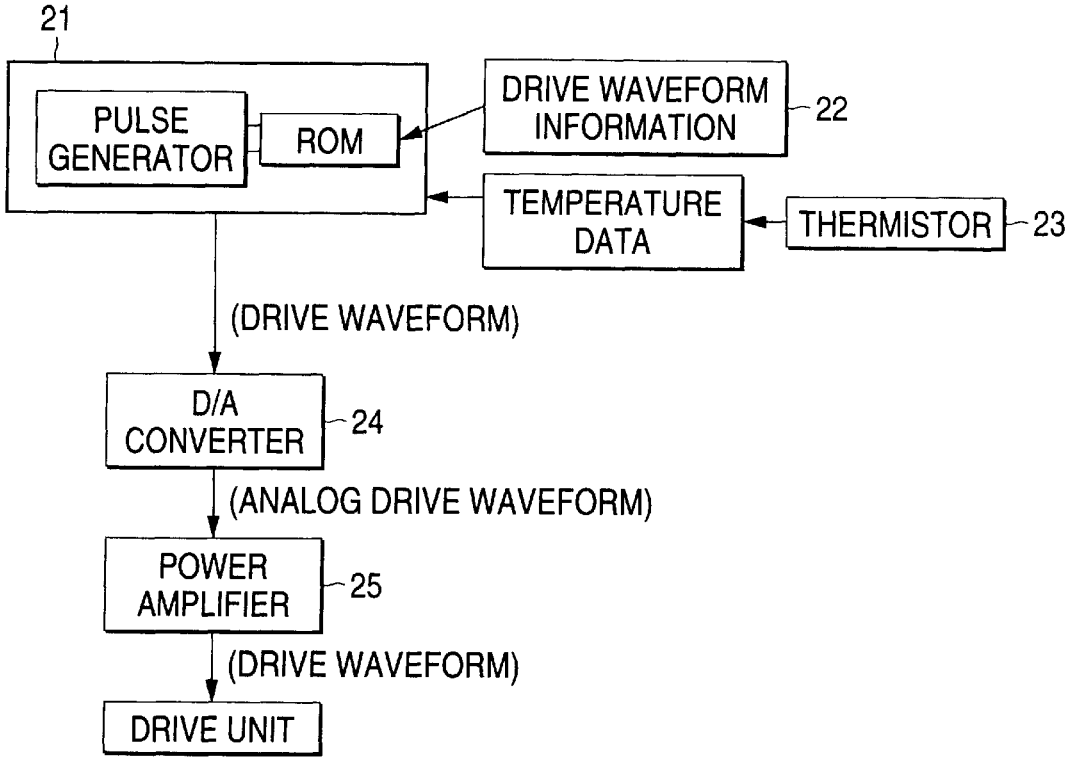
FIG. 2 is a block diagram showing a method of sending a drive waveform signal used for driving the inkjet recording head employed for the present invention.

FIG. 2 diagrammatically shows a device for sending a drive pulse signal to the foregoing recording head, which may be referred to as means for driving the pressure generating means or, more simply, as driving means. In FIG. 2, reference numeral 21 designates a pulse generator. This pulse generator comprises a ROM chip and permits generation of a desired drive waveform from waveform data burned into the ROM chip beforehand. The drive waveform data are previously provided based on data such as how to change the timing of the drove waveform according to a change in the ambient temperature. A thermistor 23 is provided in the vicinity of the pulse generator 21 and is set in such a way that ambient temperature data are constantly transmitted to the pulse generator 21.

On the basis of the data represented by the drive waveform data 22 and the data presented by the thermistor 23, the pulse generator 21 sends a digital pulse signal to a digital-to-analog converter 24, where the data concerning the drive waveform transmitted from the pulse generator 21 can be converted to analog data.

The pulse-signal converted into an analog data signal by the digital-to-analog converter 24 is amplified to the voltage and current specified by a power amplifier 25. The thus-amplified pulse signal is transmitted in the form of a drive pulse waveform to the drive unit designated by 1 in FIG. 1.

Figure 3:
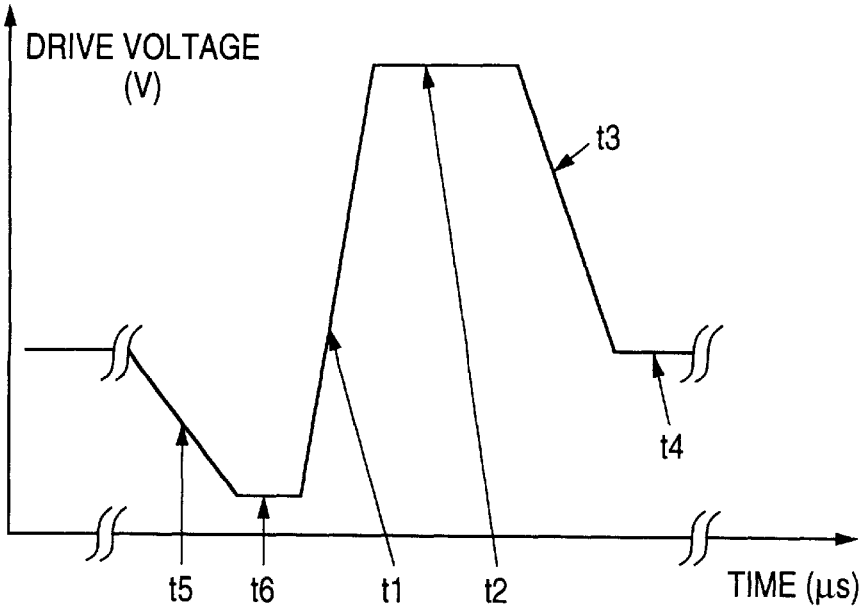
FIG. 3 is a plot showing the operation of the inkjet recording head employed for the present invention.

FIG. 3 is a plot of a drive waveform showing the operation of the foregoing recording head on the basis of the drive waveform data 22 shown in FIG. 2. Although the following description mentions that the drive waveform data "includes" various time periods, it will be understood that by this it is meant that the drive signal is generated at certain levels for particular periods of time. In FIG. 3, the drive waveform data 22 shows, before a time period (t5), a drive signal that keeps the piezoelectric vibration plate in a standby condition. In this standby condition, an intermediate drive voltage is applied to the piezoelectric vibration plate 3 (i.e., up to the instant immediately before the time period (t5). At this intermediate drive voltage, the pressure generating chamber is neither expanded nor contracted. During time period t5, the drive signal decreases. More particularly, the voltage applied to the piezoelectric vibration plate decreases from the intermediate drive voltage to a minimum drive voltage. To put it another way, piezoelectric vibration plate 3 is discharged during t5. As mentioned above, this decrease in voltage causes the pressure generating chamber 4 to expand.

The drive waveform in FIG. 3 further includes a time period t6. The drive signal during time period t6 is constant, and during t6 the above-identified minimum drive voltage is maintained with respect to the piezoelectric vibration plate 3. That is, the pressure generating chamber is kept in an expanded state during t6.

The drive waveform of FIG. 3 further comprises a time period t1. During t1, the drive signal is increased. More particularly, the voltage applied to the piezoelectric vibration plate increases from the minimum drive voltage, at the start of t1, to a final drive voltage at the end of t1. The drive signal increases during t1, and the voltage applied to piezoelectric vibration plate 3 also increases during t1. To put it differently, piezoelectric vibration plate 3 is recharged during t1, and the final drive voltage may similarly be referred to as a final recharging voltage. As mentioned above, this increase in voltage causes the constriction of the pressure generating chamber 4, which leads to the jetting of an ink droplet from nozzle 7.

The drive waveform in FIG. 3 further includes a time period t2. The drive signal during t2 remains constant, and during t2 the above-identified final recharging voltage is maintained with respect to the piezoelectric vibration plate 3. That is, the pressure generating chamber is kept in a contracted state during t2. To put it another way, it may be said that the size of the pressure generating chamber is kept substantially constant. The word "substantially" is used because the vibrations mentioned above will have some effect on the size of the pressure generating chamber.

The drive waveform in FIG. 3 further comprises a time period t3. During t3, the drive signal is decreased. More particularly, the voltage applied to the piezoelectric vibration plate decreases from the final recharging voltage, at the start of t3, to the intermediate drive voltage at the end of t3. The drive signal decreases during t3, and the voltage applied to piezoelectric vibration plate 3 also decreases during t3. To put it differently, piezoelectric vibration plate 3 is discharged during t3 to the standby state in which pressure generating chamber 4 is neither expanded nor contracted.

The drive waveform in FIG. 3 further comprises a time period t4. During t4, the drive signal remains constant and the above-identified intermediate voltage is maintained with respect to the piezoelectric vibration plate 3. That is, the pressure generating chamber is kept in the standby state during t4.

It may be noted that, to jet an ink droplet, it is necessary to compress the pressure generating chamber. The size of the pressure generating chamber immediately after jetting the ink droplet may be referred to as its compressed size. After jetting the ink droplet, it is necessary to expand the pressure generating chamber from its compressed size so that the ink in the pressure generating chamber may be replenished. In the above-identified exemplary embodiment, this contraction and expansion occurs during periods t1, t2, and t3. That is, during t1 the pressure generating chamber is brought to its compressed size, and during t3 the pressure generating chamber is expanded from its compressed size to replenish the ink in the pressure generating chamber. This contraction and replenishment occurs with the jetting of each droplet, and may be referred to as an ink jetting cycle. Thus, in the above-identified embodiment, the ink jetting cycle is the sum of the periods t1, t2, and t3.

In the above-identified exemplary embodiment, the cycle of inherent oscillation T of the piezoelectric vibration plate 3 is 8 $\mu$s. This embodiment of the invention will thus now be further described with respect to an 8 $\mu$s inherent oscillation cycle T.

Figures 4, 5:
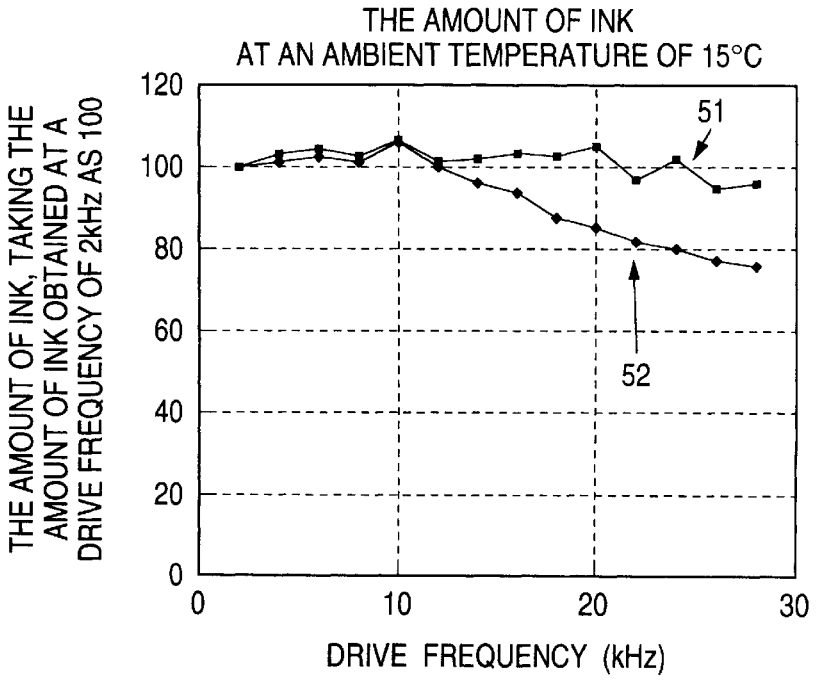
FIG. 4 is a table showing a list of drive waveform data set in the embodiment.
FIG. 5 is a plot showing the relationship between a drive frequency and the amount of ink to be squirted at the low ambient temperature.

FIG. 4 is a list of data obtained when the drive waveform is changed according to the form of the present invention. The data thus set in the list are set as the drive waveform data 22 shown in FIG. 2 and are registered as drive waveform data. At an ambient temperature of 40° C., the sum of the time periods t1, t2, and t3 is set to become a time period which is (1+1 / 4) times as much as the cycle of inherent oscillation T of the piezoelectric vibration plate 3. In contrast, at an ambient temperature of 15° C., the sum of the time periods t1, t2, and t3 is is set to a time period which is (1+3 / 4) times as much as the cycle of inherent oscillation T.

Figure 6:
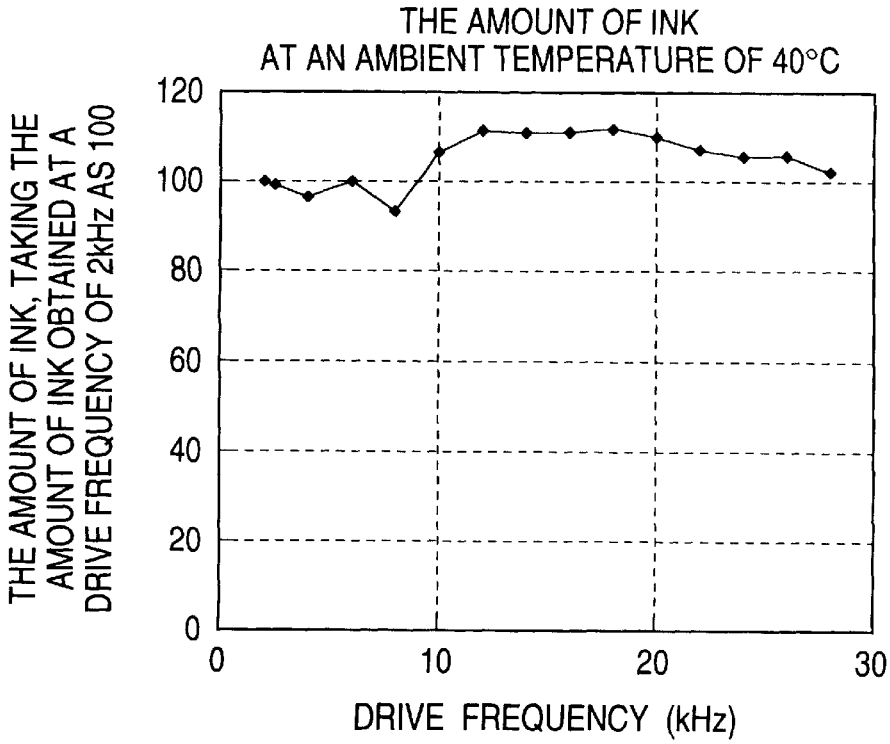
FIG. 6 is a plot showing the relationship between a drive frequency and the amount of ink to be squirted at the high ambient temperature.

FIG. 6 is a plot showing the frequency characteristics of the inkjet print head measured at an ambient temperature of 40° C.

FIG. 5 is a plot showing the frequency characteristics of the inkjet print head measured at an ambient temperature of 15° C. Reference numeral 51 designates the frequency characteristics of the inkjet print head according to the present embodiment. Reference numeral 52 designates the frequency characteristics of the inkjet print head measured while the sum of the time periods t1, t2, and t3 are set to the optimum value at an ambient temperature of 40° C. (i.e., the combination of the time periods t1, t2, and t3 used in the measurement shown in FIG. 6).

In the graph 52 shown in FIG. 5, in the region where the drive frequency exceeds 20 kHz, the supply of ink fails to keep pace with the squirting of an ink droplet. The amount of ink to be squirted significantly decreases with an increase in the drive frequency. In comparison with the graph of frequency characteristics of the print head at an ambient temperature of 40° C. (shown in FIG. 6), the amount of ink to be squirted significantly decreases with an increase in the drive frequency. In the region where the drive frequency exceeds 20 kHz, an ink droplet is linearly squirted as a result of the supply of ink lagging, resulting in picture degradation.

In comparison with the measurement result 52, the measurement result 51 shows an increase in the amount of ink to be squirted particularly at a frequency of 20 kHz or more. Further, according to the measurement result 51, the linear squirting of an ink droplet observed in the measurement result 52 is not acknowledged, and granular ink droplets can be squirted over the entire range of frequencies.

There is a considerable difference in frequency characteristics between the graph shown in FIG. 6 and the graph 52 (employing the same combination of the time periods t1, t2, and t3 as that used in the measurement shown in FIG. 6), which difference is attributable to a change in ambient temperature. In a printing operation in which an ink droplet is squirted at high frequencies and low frequencies in combination, the change in ambient temperature inevitably induces a change in the hue of a print result. In the case of the example shown in FIG. 6 and the example (i.e., the embodiment) represented by the graph 51 shown in FIG. 5, there is no substantial difference in frequency characteristics between the graphs which is attributable to the change in temperature. Therefore, no change substantially arises in the hue of a print result.

Figure 7:
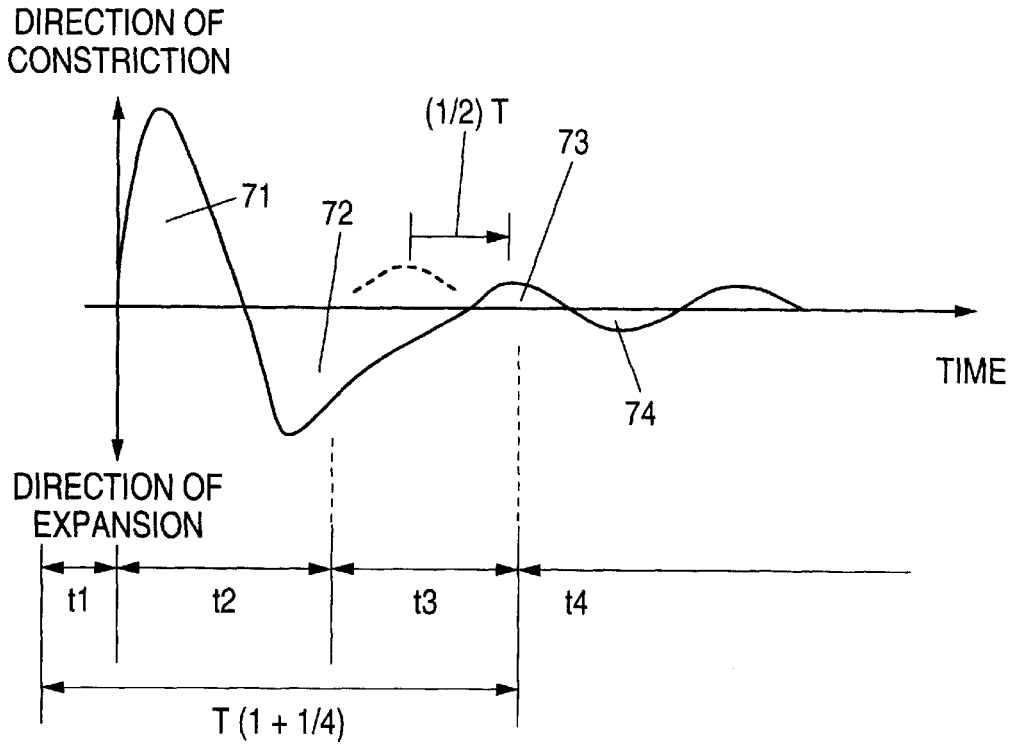
FIG. 7 is a plot showing the behavior of residual vibration of a piezoelectric vibration plate at an ambient temperature of 40° C. immediately after the vibration plate has been recharged in the present embodiment.

FIG. 7 is a plot showing the residual vibration of the piezoelectric vibration plate 3 during a time period subsequent to the time period (t1) during which an ink droplet is squirted at an ambient temperature of 40° C.

Timing is set in such a way that the residual vibration which occurs in the piezoelectric vibration plate 3 during the recharging time period t1 is completely canceled out by the discharging operation performed during the discharging time period t3. At the point in time when the pressure generation chamber 4 starts to constrict as a result of the residual vibration of the piezoelectric vibration plate 3, a pulse signal is started which expands the pressure generation chamber 4 during the discharging time period t3. At the instant immediately before the pressure generation chamber 4 starts to expand as a result of the residual vibration of the piezoelectric vibration plate 3, the discharging operation, which has been carried out during the time period t3, is terminated. The piezoelectric vibration plate 3 holds a voltage during the time period t4. As a result, the residual vibration of the piezoelectric vibration plate 3 is dampened. A residual vibration 71 arises which attempts to constrict the pressure generation chamber 4 as a result of the drastic recharging operation performed during the time period t1, and another residual vibration 72 arises which attempts to expand the pressure generation chamber 4 in reaction to the residual vibration 71. However, by virtue of the effect of the residual vibration being canceled out during the time period t3, no strong vibration appears. At this time, before and after the discharging time period t3, the residual vibration of the piezoelectric vibration plate 3 lags behind the next residual vibration by a maximum of one-half cycle. As a result, vibrations which appear in the piezoelectric vibration plate 3 after a vibration 73 lag behind vibration which would originally appear, by a one-half cycle.

In other words, the residual vibration of the piezoelectric vibration plate 3 is dampened by timing drive signal t3 to occur in opposition to part of the natural residual vibration cycle of the piezoelectric vibration plate. To put it another way, when the ambient temperature is high, the ink jetting cycle is set so as to dampen the residual vibration of the piezoelectric vibration plate.

In the present embodiment, the timing at which the residual vibration of the piezoelectric vibration plate 3 can be dampened is set in a period of time between the instant when the piezoelectric vibration plate 3 commences recharging during the recharging time period t1 and the instant when the sum of the time periods t1, t2, and t3 reaches the time period which is (1+1 / 4) times the cycle of natural frequency T (i.e., 8 $\mu$s) of the piezoelectric vibration plate 3. The amplitude of the residual vibration of the piezoelectric vibration plate 3 becomes greater if the timing is set in a period of time which is narrower or wider than the foregoing range of time.

Figure 8:
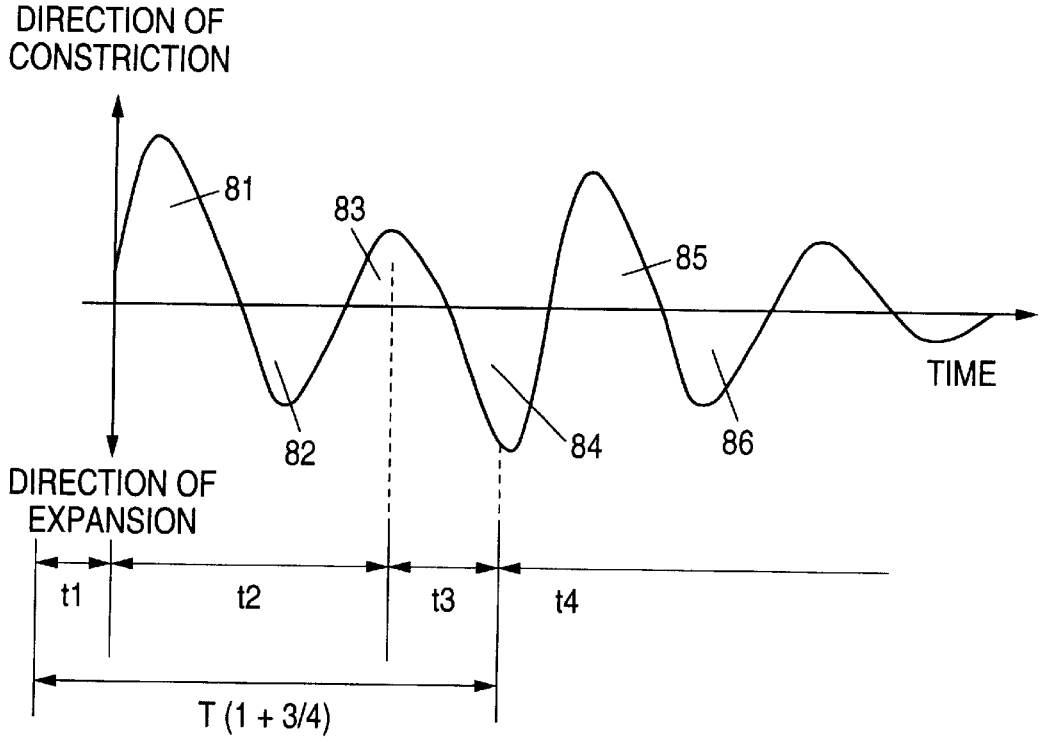
FIG. 8 is a plot showing the behavior of residual vibration of a piezoelectric vibration plate at an ambient temperature of 15° C. immediately after the vibration plate has been recharged in the present embodiment.

FIG. 8 is a plot showing the residual vibration of the piezoelectric vibration plate (represented by reference numeral 3 shown in FIG. 1) during the time period subsequent to the recharging time period t1 during which an ink droplet is squirted at an ambient temperature of 15° C. according to the present embodiment.

In contrast to FIG. 7, FIG. 8 shows the residual vibration which occurs in the piezoelectric vibration plate 3 at an ambient temperature of 15° C. according to the present embodiment, in which timing is set in such a way as to eliminate the effect of canceling out residual vibration during the discharging time period t3. At the instant when the pressure generation chamber 4 is expanded as a result of the residual vibration of the piezoelectric vibration plate 3, a pulse signal is started which expands the pressure generation chamber 4 during the discharging time period t3, so that the pressure generation chamber 4 is expanded to a much greater extent by the residual vibration. The discharging time period t3 is terminated imediately before the pressure generation chamber 4 begins to constrict after having expanded to the maximum extent by the residual vibration. The waveform enters the time period 4 during which a voltage is maintained, so that strong residual vibration still remains. As shown in FIG. 8, three residual vibrations appear, namely, a residual vibration 81 which attempts to constrict the pressure generation chamber 4 as a result of the drastic recharging of the piezoelectric vibration plate 3 during the recharging time period 3; a residual vibration 82 which attempts to expand the pressure generation chamber 4 in reaction to the residual vibration 81; and a residual vibration 83 which attempts to constrict the pressure generation chamber 4 in reaction to the residual vibration 82. The amplitude of a residual vibration 84 (i.e., which expands the pressure generation chamber 4) becomes higher under the influence of the discharging operation performed during the time period t3. From then on, the pressure generation chamber 4 is alternately constricted (by a residual vibration 85) and expanded (by a residual vibration 86). However, when the ambient temperature is low, ink has great viscosity. Therefore, the meniscus attenuates more quickly than at a high ambient temperature. The meniscus attenuates during substantially the same attenuation period. The residual vibration of the piezoelectric vibration plate 3 does not change in phase before and after the discharging time period t3.

In other words, the residual vibration of the piezoelectric vibration plate 3 is reinforced by timing drive signal t3 to occur in synchronism with part of the natural residual vibration cycle of the piezoelectric vibration plate. To put it another way, when the ambient temperature is low, the ink jetting cycle is set so as to reinforce the residual vibration of the piezoelectric vibration plate.

According to the present embodiment, the timing at which the amplitude of the residual vibration of the piezoelectric vibration plate 3 at an ambient temperature of 15° C. is increased and the waveform enters the time period t4 is set within a period of time between the instant when the piezoelectric vibration plate 3 commences the recharging operation in the recharging time period t1 and the instant when the sum of the time periods t1, t2, and t3 reaches the time period which is (1+3 / 4) times the cycle of natural frequency T (i.e., 8 $\mu$s) of the piezoelectric vibration plate 3. The amplitude of the residual vibration of the piezoelectric vibration plate 3 becomes higher than that shown in FIG. 7 if the timing is set in the range of time which is narrower or wider than the foregoing range of time.

After the squirting of an ink droplet, the meniscus is deeply drawn into the pressure generation chamber 4. After the lapse of a given time period, the direction in which the meniscus is drawn is reversed, and the meniscus moves toward the discharge orifice (in the direction designated by reference numeral 7 shown in FIG. 1) while repeating vibration in synchronism with the inherent oscillations of the piezoelectric vibration plate 3 (i.e., the oscillations shown in FIGS. 7 and 8). As shorter becomes the time period between the instant when the meniscus is drawn to the pressure generation chamber 4 after the squirting of an ink droplet and the instant when the meniscus reaches the discharge orifice 7, the shorter can become the time interval during which the amount of ink required for the next squirting operation can be stably ensured. As a result, even if the drive frequency is increased, there can be ensured ink, which is the same in amount as the next ink droplet to be squirted, while the vibration of the meniscus is completely dampened.

At an ambient temperature of 15° C., the amplitude of the residual vibration of the piezoelectric vibration plate 3 is increased during the discharging time period t3. After the completion of the discharging time period t3 (i.e., the residual vibration 84), the meniscus is drawn to a much deeper position in the pressure generation chamber 4. If the discharging time period t3 during which the residual vibration of the piezoelectric vibration plate 3 is dampened is used, the print head is in a state such as that similar to the example (shown in FIG. 7) having an ambient temperature of 40° C. At the completion of the discharging time period t3 (i.e., during the period of the residual vibration 72), the meniscus is drawn to a less deeper position in the pressure generation chamber 4 as compared to the position where the meniscus is drawn when the amplitude of the residual vibration still remains high.

Figure 9:
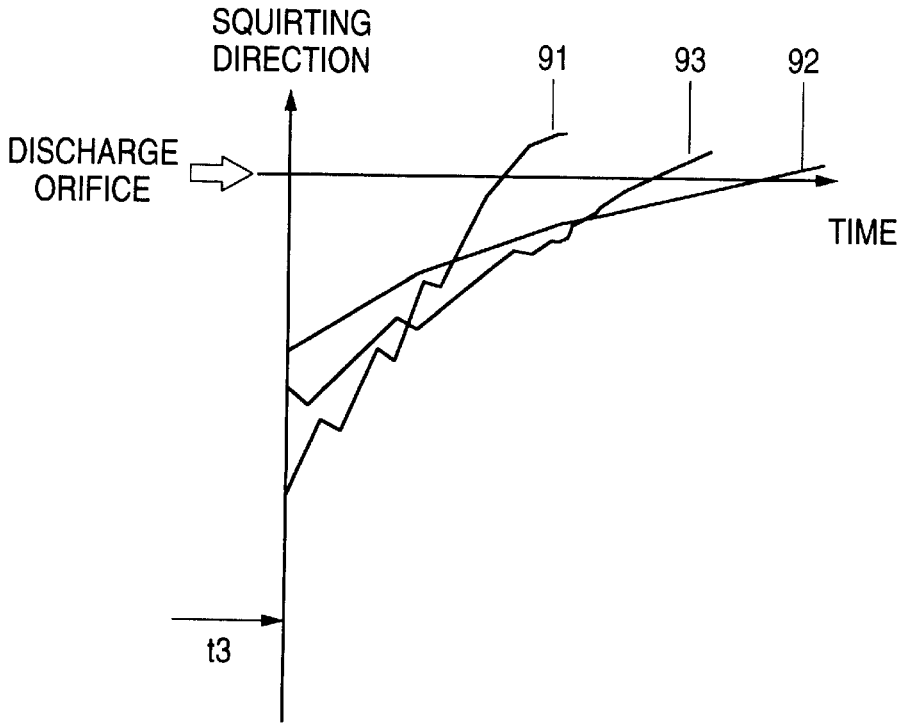
FIG. 9 is a plot showing the behavior of attenuation oscillation of a nozzle meniscus in the present embodiment.

FIG. 9 shows the progress of attenuation of the nozzle meniscus in the case of the residual vibration of the piezoelectric vibration plate 3 having a high amplitude, as well as of the residual vibration having a low amplitude. Reference numeral 91 designates a case where the meniscus is strongly drawn after the discharging time period t3 (i.e., the present embodiment in which the amplitude of the residual vibration is high), and reference numeral 92 designates attenuation vibration in a case where the meniscus is little withdrawn. In the attenuation 92 of the meniscus, the amplitude of the residual vibration of the piezoelectric vibration plate 3 is not so high, and the meniscus shows a behavior similar to natural damping. In contrast, in the case of the attenuation 91 of the meniscus, at the instant immediately after the completion of the discharge time period t3, the residual vibration of the piezoelectric vibration plate 3 has a phase in which the maximum pressure is produced in the direction in which the pressure generation chamber 4 is expanded to its greatest extent (i.e., in the direction in which the meniscus is pushed to the discharge orifice 7). Further, since the residual vibration has the highest amplitude, the residual vibration has the greatest pressure to push the meniscus. The pressure generation chamber 4 is expanded by a reaction from the residual vibration. More specifically, as a result of the attenuation of the residual vibration of the piezoelectric vibration plate 3, the pressure at which the meniscus is withdrawn to the pressure generation chamber 4 becomes inevitably smaller than the immediately preceding pressure at which the meniscus is pushed to the nozzle discharge. As a result of the attenuation 91 of the meniscus, the maximum pressure for the purpose of restoring the meniscus to the discharge orifice 7 can be applied to a channel.

In the case of the attenuation 92 of the meniscus, in which the residual vibration becomes very small after the discharging time period t3, at the instant immediately after the completion of the discharge time period t3, the residual vibration of the piezoelectric vibration plate 3 has a phase in which the maximum pressure is produced in the direction in which the pressure generation chamber 4 is expanded to its greatest extent (i.e., in the direction in which the meniscus is withdrawn to the pressure generation chamber 4). However, since the residual vibration of the piezoelectric vibration plate 3 has a very low amplitude, there is little either pressure to restore the meniscus to the discharge orifice 7 or pressure to withdraw the meniscus to the pressure generation chamber 4.

In the case of the attenuation 93 of the meniscus which is in between the attenuation 91 of the meniscus and the attenuation 92 of the meniscus in terms of the effect of damping the piezoelectric vibration plate 3, at the instant immediately after the completion of the discharging time period t3, the attenuation 93 has a phase which is in between the phase of the attenuation 91 and the phase of the attenuation 92. Further, in terms of amplitude, the piezoelectric vibration plate 3 obtained at the attenuation 93 is in between the piezoelectric vibration plate obtained at the attenuation 91 and the piezoelectric vibration plate 3 obtained at the attenuation 92. Accordingly, the pressure to resume the meniscus to the discharge orifice 7 is in between the pressure obtained at the attenuation 91 and the pressure obtained at the attenuation 92.

As a result, in order to immediately resume the nozzle meniscus to the discharge orifice 7 after the discharging time period t3, it is better to oscillate the residual vibration of the piezoelectric vibration plate 3 to a greatest extent, as in the embodiment.

As mentioned previously, dampening the residual vibration is of the piezoelectric vibration plate 3 causes a phase shift during the discharging time period t3. As in the embodiment having an ambient temperature of 15° C., in the state in which the residual vibration is oscillated to the greatest extent during the discharge time period t3, no phase shift occurs. That is, when the residual vibration is dampened, a phase shift occurs, but when the residual vibration is reinforced, no phase shift occurs. During the discharging time period t3, as the residual vibration becomes dampened, the phase of the piezoelectric vibration plate 3 advances in the direction in which the phase lags by the maximum of a time period which is one-half the cycle of inherent oscillation T. The residual vibration which initially constricts the pressure generation chamber 4 after the discharging time period T3 lags by only the period of time corresponding to the phase shift. As a result, there arises a lag in the time required to restore the nozzle meniscus to the discharge orifice 7. As the phase shift becomes smaller, namely, the piezoelectric oscillation plate 3 oscillates during the discharging time period t3, the time required to restore the meniscus to the discharge orifice 7 after the squirting of an ink droplet becomes shorter. Therefore, even in a case where an ink droplet is squirted at a high drive frequency at an ambient temperature of 15° C., the supply of ink droplets can keep pace with the squirting action of the head.

At an ambient temperature of 15° C., the residual vibration of the piezoelectric vibration plate 3 has the highest amplitude in the state according to the present embodiment (shown in FIG. 8). If the sum of the time periods t1, t2, and t3 according to the present embodiment is decreased or increased, the amplitude of the residual vibration of the piezoelectric vibration plate 3 becomes smaller after the discharging time period t3. In terms of the position to which the meniscus is withdrawn after the discharging time period t3, as well as of phase shift, there arises a lag in the time required for the nozzle meniscus to be pushed back to the discharge orifice 7 after having been withdrawn to a deep position in the pressure generation chamber 4 as a result of squirting of an ink droplet. Consequently, there arises a decrease in the amount of ink to be squirted at a high frequency at an ambient temperature of 15° C.

The foregoing method; that is, the method by which the ability of the ink head to supply an ink droplet at the time of a high-frequency operation is increased by excitation of the residual vibration of the piezoelectric vibration plate 3 after the discharging time period t3, is desirably to be used in a state in which ink has comparatively high viscosity. More specifically, it is desirable to use the method in a state such as that according to the embodiment having an ambient temperature of 15° C.

As in the previous embodiment, in a state such as that in which the ambient temperature is 40° C. and ink has low viscosity, the residual vibration of the piezoelectric vibration plate 3 is gradually dampened with a decrease in the viscosity of ink (i.e., an increase in the ambient temperature). As a result, unexpected squirting of an ink droplet which would otherwise be caused by the residual vibration of the piezoelectric vibration plate 3 is prevented, which in turn makes it possible to prevent an excessive increase in the amount of ink to be squirted which would otherwise be caused by a decrease in the viscosity of ink.

In the state in which the ambient temperature is 15° C. and ink has high viscosity, the sufficient amount of ink to be squirted can be ensured by maximizing the ability of the ink head to supply ink without dampening the vibration of the piezoelectric vibration plate 3, as in the case of the previous embodiment. Unexpected squirting of an ink droplet which would be otherwise caused by the residual vibration of the piezoelectric vibration plate 3 does little occur in the state in which the ambient temperature is 15° C. and ink has high viscosity. Accordingly, in terms of frequency characteristics, it becomes possible to ensure an analogous tendency over the entire range of ambient temperatures. Further, even when the print head is driven at a high frequency at an ambient temperature of 15° C., granular ink droplets can be obtained.

In the present embodiment, one is selected as the numerical value "n," and the sum of the time periods t1, t2, and t3 is set to the time period which is (1+3 / 4) times as much as the cycle of inherent oscillation T of the piezoelectric vibration plate 3. Further, the ambient temperature is set to a low temperature in the present embodiment. There are three reasons for the use of these settings. First, the residual vibration of the piezoelectric vibration plate 3 can be well dampened at an ambient temperature of 40° C. Second, there is achieved the greatest ability of the ink head to supply ink at an ambient temperature of 15° C. Third, undesired squirting of an ink droplet which would be otherwise caused by the residual vibration of the piezoelectric vibration plate 3 is prevented. It is generally desirable for the sum of the time periods t1, t2, and t3 to range from the time period which is a reference time period and is (n+1 / 4) (where n=1, 2, 3) times as much as the cycle of inherent oscillation T to a time period which is greater or smaller than the reference time period by one-half of T. The residual vibration of the piezoelectric vibration plate 3 falls well within the foregoing range of time periods.

Although the explanation has described the embodiment with reference to the example in which the cycle of inherent oscillation T of the pressure generation means is 8 $\mu$s, it is evident that the recording head operates in every cycle of inherent oscillation in the same manner as that in the previous embodiment.

In the case of another recording head other than the head that utilizes the flexural oscillation of the piezoelectric vibration plate and is employed in the previous embodiment, e.g., an inkjet recording head which utilizes longitudinal oscillation of a piezoelectric vibrator, the working effect analogous to that yielded in the previous embodiment will be obtained.

In the above-identified embodiment, the periods t1 and t3 were kept the same, but holding period t2 was adjusted so as to change the sum of t1, t2, and t3. Other ways of changing the sum will be apparent to one familiar with this field.

Also, the above-identified embodiment was described with respect to a head in which an initial expansion of the pressure generating chamber occurred prior to the contraction that jetted an ink droplet. It will be appreciated that such an initial or preliminary expansion is not necessary to the practice of this invention. It also will be appreciated that a print head may be used in which the pressure generating chamber is expanded, then contracted to its original size to jet a droplet, and then expanded to draw ink for the next jetting operation. In other words, a print head can be operated without compressing the pressure generating chamber below its "normal" size. The invention is, of course, equally applicable to such a print head. In particular, the ink jetting cycle as defined above applies as follows to such a print head. As before, to jet an ink droplet, it is necessary to compress the pressure generating chamber. The size of the pressure generating chamber starts out large in the cycle, and is compressed to its normal size to jet the droplet. Here, the normal size is, with respect to the ink jetting cycle, its compressed size. In other words, the pressure generating chamber is as small as it gets during operation. After jetting the ink droplet, it is necessary to expand the pressure generating chamber from its compressed size so that the ink in the pressure generating chamber may be replenished. That is, the pressure generating chamber is again made large so as to draw in ink. This contraction and replenishment occurs with the jetting of each droplet, and makes up the ink jetting cycle.

As has been described above, in the present invention, the sum of the time periods t1, t2, and t3 is set to a time period which is (n+1 / 4) (where n=1, 2, 3) times as much as the cycle of inherent oscillation T of the piezoelectric vibration plate. According to a decrease in the ambient temperature, the sum of the time periods is changed so as to become close to a time period which is (n+3 / 4) times as much as T or a time period which is (n−1 / 4) times as much as T. As a result, the amount of ink can be increased over a high frequency drive band at the low ambient temperature, and granular ink droplets can also be obtained.

The change in the frequency characteristics of the print head due to a change in the ambient temperature can be significantly improved, whereby the change in the hue of a print result due to a change in the ambient temperature can also be improved, and the need for an ink heater is eliminated.

What is claimed is:

1. A method for driving an inkjet print head for ejecting ink droplets from nozzle openings by applying a drive voltage to a pressure generation chamber, the pressure generation chamber communicating with an ink chamber and the nozzle openings, the inkjet print head driving method comprising steps of:

a first step of applying the drive voltage for contracting the pressure generation chamber;

a second step of substantially maintaining the drive voltage after said first step; and a third step of expanding the pressure generation chamber after said second step, wherein a timing of executing said third step is varied for controlling residual vibrations of the pressure generation chamber in accordance with ambient temperature of ink.

2. The inkjet print head driving method of claim 1, wherein said timing of executing said third step is varied for substantially unchanging the residual vibrations of the pressure generation chamber even when the ambient temperature of the ink lowers.

3. The inkjet print head driving method of claim 2, wherein the sum of the time periods for the first, second and third steps increases within a range of from (n+¼)T to (n+¾)T, where n∈{1,2,3} and T is a cycle of inherent oscillation of the pressure generation chamber, according to the decrease of the ambient temperature of the ink.

4. The inkjet print head driving method of claim 2, wherein the sum of the time periods for the first, second and third steps decreases within a range of from (n+¼)T to (n−¼)Y, where n∈{1,2,3} and T is a cycle of inherent oscillation of the pressure generation chamber, according to the decrease of the ambient temperature of the ink.

5. An inkjet print head driving device for ejecting ink droplets from an inkjet print head having nozzle openings, and a pressure generation chamber communicating with an ink chamber and the nozzle openings, wherein the driving device generates a drive signal which actuates the pressure generation chamber, said drive signal comprising:

a first drive waveform for applying a drive voltage for contracting the pressure generation chamber;

a second drive waveform for substantially maintaining the drive voltage; and a third drive waveform for expanding the pressure generation chamber, wherein the second drive waveform is executed after the first drive waveform and the third drive waveform is executed after the second drive waveform, and wherein a timing of executing the third drive waveform is varied for controlling residual vibrations of the pressure generation chamber in accordance with ambient temperature of ink.

6. The inkjet print head driving device of claim 5, wherein said timing of executing the third drive waveform is varied for substantially unchanging the residual vibrations of the pressure generation chamber even when the ambient temperature of the ink lowers.

7. The inkjet print head driving device of claim 5, wherein the sum of the time periods for executing the first, second and third drive waveforms increases within a range of from $(n+\frac{1}{4})T$ to $(n+\frac{3}{4})T$, where $n\epsilon\{1,2,3\}$ and T is a cycle of inherent oscillation of the pressure generation chamber, according to a decrease of the ambient temperature of the ink.

8. The inkjet print head driving device of claim 5, wherein the sum of the time periods for the first, second and third steps decreases within a range of from $(n+\frac{1}{4})T$ to $(n-\frac{1}{4})T$, where $n\epsilon\{1,2,3\}$ and T is a cycle of inherent oscillation of the pressure generation chamber, according to a decrease of the ambient temperature of the ink.

* * * * *